US007618302B2

(12) United States Patent
Collins et al.

(10) Patent No.: US 7,618,302 B2
(45) Date of Patent: Nov. 17, 2009

(54) TOY PLAY SET

(75) Inventors: Gary Collins, Lawndale, CA (US); Stephen Lau, Los Angeles, CA (US); Alan O'Bryan, Lakewood, CA (US)

(73) Assignee: Mattel, Inc., El Segundo, CA (US)

( * ) Notice: Subject to any disclaimer, the term of this patent is extended or adjusted under 35 U.S.C. 154(b) by 411 days.

(21) Appl. No.: 11/343,176

(22) Filed: Jan. 30, 2006

(65) Prior Publication Data

US 2006/0128256 A1 Jun. 15, 2006

Related U.S. Application Data

(63) Continuation of application No. PCT/US2005/037947, filed on Oct. 20, 2005.

(60) Provisional application No. 60/622,115, filed on Oct. 26, 2004.

(51) Int. Cl.
*A63H 18/00* (2006.01)

(52) U.S. Cl. ..... 446/174; 446/168; 446/444

(58) Field of Classification Search ..... 220/707; 238/10 A, 10 F; 446/75, 168, 174, 444
See application file for complete search history.

(56) References Cited

U.S. PATENT DOCUMENTS

| | | | | |
|---|---|---|---|---|
| 141,414 | A | | 8/1873 | Arnaud |
| 296,012 | A | | 4/1884 | Jackson |
| 408,635 | A | | 8/1889 | Sommer |
| 475,067 | A | | 5/1892 | Risdon |
| 603,186 | A | | 4/1898 | Griffis |
| 878,810 | A | | 2/1908 | Letzkus |
| 1,103,865 | A | | 7/1914 | Caler |
| 1,296,129 | A | | 3/1919 | Siegel |
| 2,450,244 | A | * | 9/1948 | Lynch ..... 229/103.1 |
| 2,544,594 | A | | 3/1951 | Goldfarb |
| 3,296,735 | A | | 1/1967 | Djedda |
| 3,498,615 | A | | 3/1970 | Toutoundjis |
| 3,578,320 | A | | 5/1971 | Goldfarb et al. |
| 3,643,951 | A | | 2/1972 | Breslow |

(Continued)

FOREIGN PATENT DOCUMENTS

GB 725420 3/1955

OTHER PUBLICATIONS

K'Nex, *K'Nex 2004* Catalogue, p. 4 (2004).

*Primary Examiner*—John Ricci
(74) *Attorney, Agent, or Firm*—Panitch Schwarze Belisario & Nadel LLP

(57) ABSTRACT

A toy play set includes a body having opposing ends and a side wall therebetween, which define and generally surround an at least partially hollow cavity within the body in a closed configuration of the body. At least the one end is sized and shaped to fit at least partially into a beverage cup holder of a vehicle sufficiently for the cup holder to support the body in a generally upright orientation. The body has an open configuration in which the hollow cavity is at least partially accessible. A toy vehicle track as long or longer than the length of the body between the ends is configured for storage within the cavity of the body in the closed configuration and is engaged with the body for play in the open configuration.

31 Claims, 6 Drawing Sheets

U.S. PATENT DOCUMENTS 3,683,514 A 8/1972 Hughes
3,761,094 A 9/1973 Belisle
4,032,141 A 6/1977 Tanimura
4,103,774 A 8/1978 Shingyouchi
4,135,715 A 1/1979 Soulos
4,153,250 A 5/1979 Anthony
4,260,155 A 4/1981 Jordan
4,297,807 A 11/1981 Buettner
4,348,028 A 9/1982 Barlow
4,357,778 A 11/1982 Matsumoto et al.
4,408,763 A 10/1983 Simons
4,433,504 A 2/1984 Terui
4,462,503 A * 7/1984 Di Raffaele et al. ..... 220/707
4,558,867 A 12/1985 Hippely
4,581,904 A 4/1986 Lehmann et al.
4,585,166 A 4/1986 Stephens
4,696,652 A 9/1987 Reeder et al.
4,713,038 A 12/1987 Wichman et al.
4,923,429 A 5/1990 Lewis
4,946,413 A 8/1990 Lehmann et al.
4,964,831 A 10/1990 Wolff
4,966,277 A 10/1990 Razzore
5,029,700 A 7/1991 Chen
5,035,324 A 7/1991 Bertrand
5,074,561 A 12/1991 Johnson
5,167,564 A 12/1992 Lord
5,197,735 A 3/1993 Land et al.
5,209,345 A 5/1993 Haugabook
5,211,298 A * 5/1993 Bloch ..... 215/11.1
5,224,894 A 7/1993 Nelson et al.
5,261,848 A 11/1993 Kaplan et al.
5,312,285 A 5/1994 Rieber et al.
5,362,050 A 11/1994 Matsuyama
5,370,391 A 12/1994 Hilzendeger et al.
5,375,828 A 12/1994 Shikami
5,419,436 A 5/1995 Powell
5,540,611 A 7/1996 Lapoint et al.
5,569,867 A 10/1996 Levine
5,632,926 A 5/1997 Dyer, Jr.
5,803,306 A 9/1998 Lewis
5,851,415 A 12/1998 Thomas
5,897,418 A 4/1999 Spector
5,931,099 A 8/1999 Bruner et al.
5,980,352 A 11/1999 Rigberg
5,996,781 A 12/1999 Glaser et al.
6,098,794 A 8/2000 Lin
6,117,502 A 9/2000 Liao
6,120,295 A 9/2000 Pracas
6,146,721 A 11/2000 Freynet
6,203,393 B1 3/2001 Flynn
6,210,762 B1 4/2001 Pielow
6,247,729 B1 6/2001 Kaufman
6,345,822 B1 2/2002 Reynolds
6,367,799 B1 4/2002 Sippel
6,506,094 B1 1/2003 Chang
6,508,179 B2 1/2003 Annis et al.
6,575,807 B2 6/2003 Spector
6,619,962 B1 9/2003 Gubitosi et al.
6,652,024 B2 11/2003 Prasatek
6,695,667 B1 2/2004 Kee
6,719,606 B1 4/2004 Mukensturm
6,752,679 B1 6/2004 Lui
6,783,419 B1 8/2004 Paukert et al.
6,793,570 B1 9/2004 Wekstein
2002/0039609 A1 4/2002 Bezek et al.
2002/0182974 A1 12/2002 Grabianski
2004/0203317 A1 10/2004 Small
2005/0012274 A1 1/2005 Ritter et al.
2005/0017452 A1 1/2005 Stein
2005/0245168 A1 11/2005 Kay et al.
2006/0066047 A1 3/2006 Kay et al.
2006/0087076 A1 4/2006 Collins et al.
2006/0128256 A1 6/2006 Collins et al.

* cited by examiner

TOY PLAY SET

CROSS-REFERENCE TO RELATED APPLICATIONS

This patent application is a continuation of International Application No. PCT/US2005/037947, filed Oct. 20, 2005, which claims priority to U.S. Provisional Patent Application No. 60/622,115, filed Oct. 26, 2004, both entitled "Toy Play Set", the disclosures of which are incorporated herein by reference.

FIELD OF THE INVENTION

This invention generally relates to toy play sets, and in particular to toy play sets for use with conventional, unpowered, scaled toy vehicles.

BACKGROUND OF THE INVENTION

It is known to provide play sets for use with reduced scale (e.g., 1/64 Hot Wheels® and Matchbox) toy vehicles. Conventional scaled toy vehicle play sets are not well-suited for use by a child while riding in a vehicle such as a car. They are usually too large to set up and use in a car or other vehicle and often lack structure to secure toy vehicles and other loose pieces of the play set during travel. It is believed that a toy vehicle play set adapted for use by a child riding in a vehicle and that can secure its components would be desirable.

BRIEF SUMMARY OF THE INVENTION

Briefly stated, the present invention is a toy play set particularly for use in a vehicle having a beverage cup holder. The toy play set comprises a body having first and second opposing ends and a side wall extending therebetween. The first and second ends and the side wall define an at least partially hollow cavity within the body, whereby the first and second ends and the side wall generally surround the hollow cavity in a closed configuration of the body. The body has in the closed configuration at least the first end sized and shaped to fit at least partially into the cup holder sufficiently for the cup holder to support the body in a first generally upright orientation with the second end forming a top end of the body. The body has an open configuration in which the hollow cavity is at least partially accessible. A generally continuous track is sized and configured for storage within the cavity of the body in the closed configuration. The track is accessible for play and engaged with the body in the open configuration. The track has a length at least generally as long as the body between the first and second ends.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
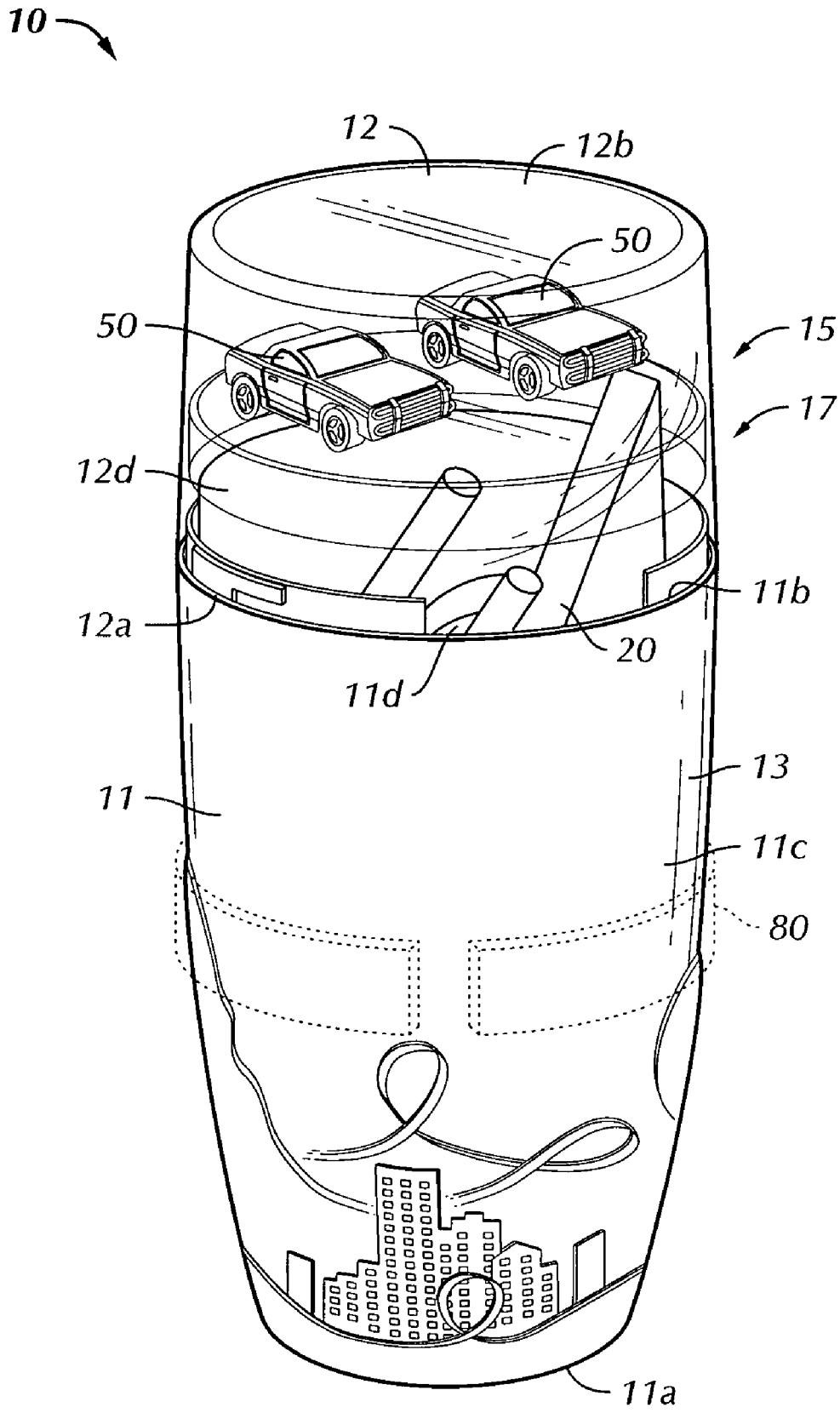
FIG. 1 is a perspective view of a toy play set, shown in a storage configuration, in accordance with a first preferred embodiment of the present invention.

Certain terminology is used in the following description for convenience only and is not limiting. The words "right," "left," "upper," and "lower" designate directions in the drawings to which reference is made. The terminology includes the words above specifically mentioned, derivatives thereof, and words of similar import.

Referring to the drawings in detail, wherein like numerals indicate like elements throughout, there are shown in FIGS. 1-6 preferred embodiments of a toy play set, indicated generally at 10, 110, 210, in accordance with the present invention. The toy play set 10, 110, 210 is intended to be used by children, and is particularly designed for use while traveling in vehicles (not shown). As such, at least one end of the toy play set 10, 110, 210 is appropriately sized to fit in a standard beverage cup holder 80 (in phantom in FIGS. 1 and 4) of an automobile (not shown) or other such vehicle (not shown).

Referring to FIGS. 1-4, there is shown the toy play set 10 of the first preferred embodiment having a track 20 and at least one miniature vehicle 50 configured and scaled to fit on and roll or otherwise travel along the track 20. Preferably, the toy play set 10 includes two miniature vehicles 50, although it is within the spirit and scope of the present invention that the toy play set 10 include more or less than two miniature vehicles 50.

Referring specifically to FIG. 1, the toy play set 10 includes a generally cylindrical body 11 having first and second opposing ends 11*a*, 11*b* and a side wall 11*e* extending therebetween. Preferably, the side wall 11*c* of the body 11 is generally annular. The first and second ends 11*a*, 11*b* and the side wall 11*c* preferably define an at least partially hollow cavity 11*d* within the body 11, whereby the first and second ends 11*a*, 11*b* and the side wall 11*c* generally surround the hollow cavity 11*d* in a closed configuration 17 of the body 11. The toy play set 10, when in the closed configuration 17, is essentially in the form of a generally cylindrical canister, including a lid 12 that preferably releasably engages with the body 11 to form a generally shell-like container. Specifically, it is preferred that the lid 12 is removably engageable with at least one and preferably both of the first and second ends 11*a*, 11*b* of the body 11 in the closed configuration 17. The lid 12 is preferably generally cup-shaped with an open end 12*a* and an oppositely disposed closed end 12*b*. A sidewall preferably extends generally perpendicularly from an outer circumference of the closed end 12*b* to form the open end 12*a*. Furthermore, although not required, it is preferred that the lid 12 have a platform 12*d*, which can be engaged within an interior 12*c* of the lid 12 for at least displaying the at least one miniature vehicle 50 to be used with the toy play set 10.

Preferably, when in the closed configuration 17, the body 11 has at least the first end 11*a* sized and shaped to fit at least partially into the cup holder 80 sufficiently for the cup holder 80 to support the body 11 in a first generally upright orientation 15 with the second end 11*b* forming a top end of the body 11. Additionally, it is preferred that the lid 12 is also sized and shaped to fit at least partially into the cup holder 80, so that, when engaged with either the first or second end 11*a*, 11*b*, the lid 12 can be engaged within the cup holder 80 in order to retain the toy play set 10 therein and inhibit movement of the toy play set 10 within the vehicle.

Preferably, the body 11 includes at least first and second portions 11*e*, 11*f*. The first portion 11*e* preferably is removably engageable with the second portion 11*f*, the first and second portions 11*e*, 11*f* preferably interlocking along sides and a bottom thereof, e.g., by tongue and groove, bayonet connectors, or the like, when the body 11 is in the closed configuration 17. When in the closed configuration 17, the first and second portions 11*e*, 11*f* of the body 11 are engaged in a first arrangement 13 in which each of the first and second portions 11*e*, 11*f* forms at least part of the generally cylindrical side wall 11*c* of the body 11. Preferably, the first portion 11*e* makes up all of a bottom portion and approximately half of the remainder of the side wall 11*c* of the body 11, and the second portion 11*f* preferably makes up the remaining half of the side wall 11*c* of the body 11.

In the closed configuration 17 of the body 11, the open end 12*a* of the lid 12 preferably interlocks with the second end 11*b* of the body 11, e.g., by tongue and groove, mating threads, bayonet connectors, or the like. When in the closed configuration 17, the body 11 and lid 12 contain (or are at least capable of containing) all of the below-described components (namely, disassembled sections or segments 21 of the track 20 and the miniature vehicles 50) within. Although not separately shown, the toy play sets 110, 210 of the second and third preferred embodiments appear similar to the toy play set 10 of the first preferred embodiment when in the closed configuration 17.

Figure 2:
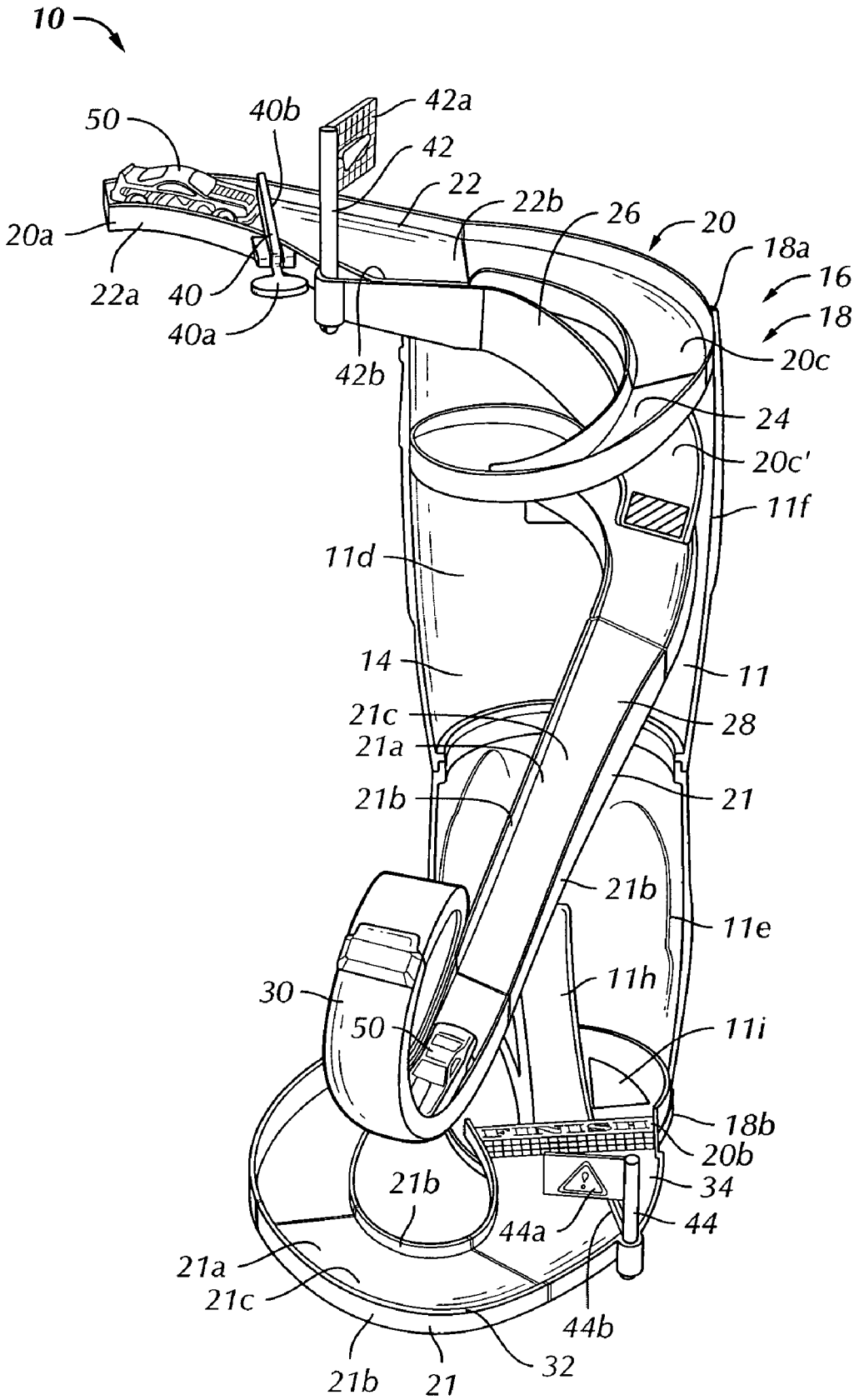
FIG. 2 is a front perspective view of the toy play set of FIG. 1, shown in a play configuration.
Figure 3:
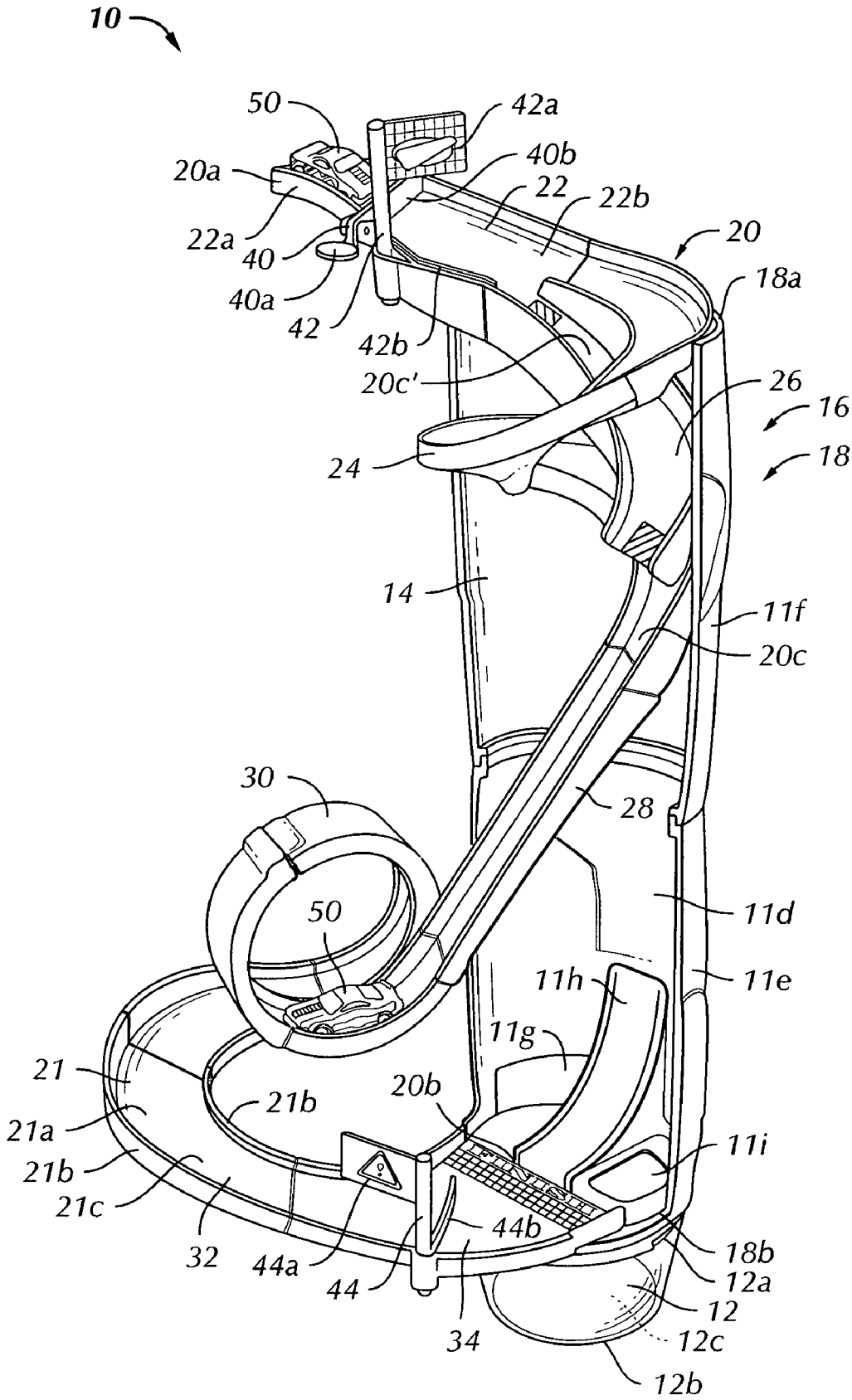
FIG. 3 is a front right perspective view of the toy play set of FIG. 2.
Figure 4:
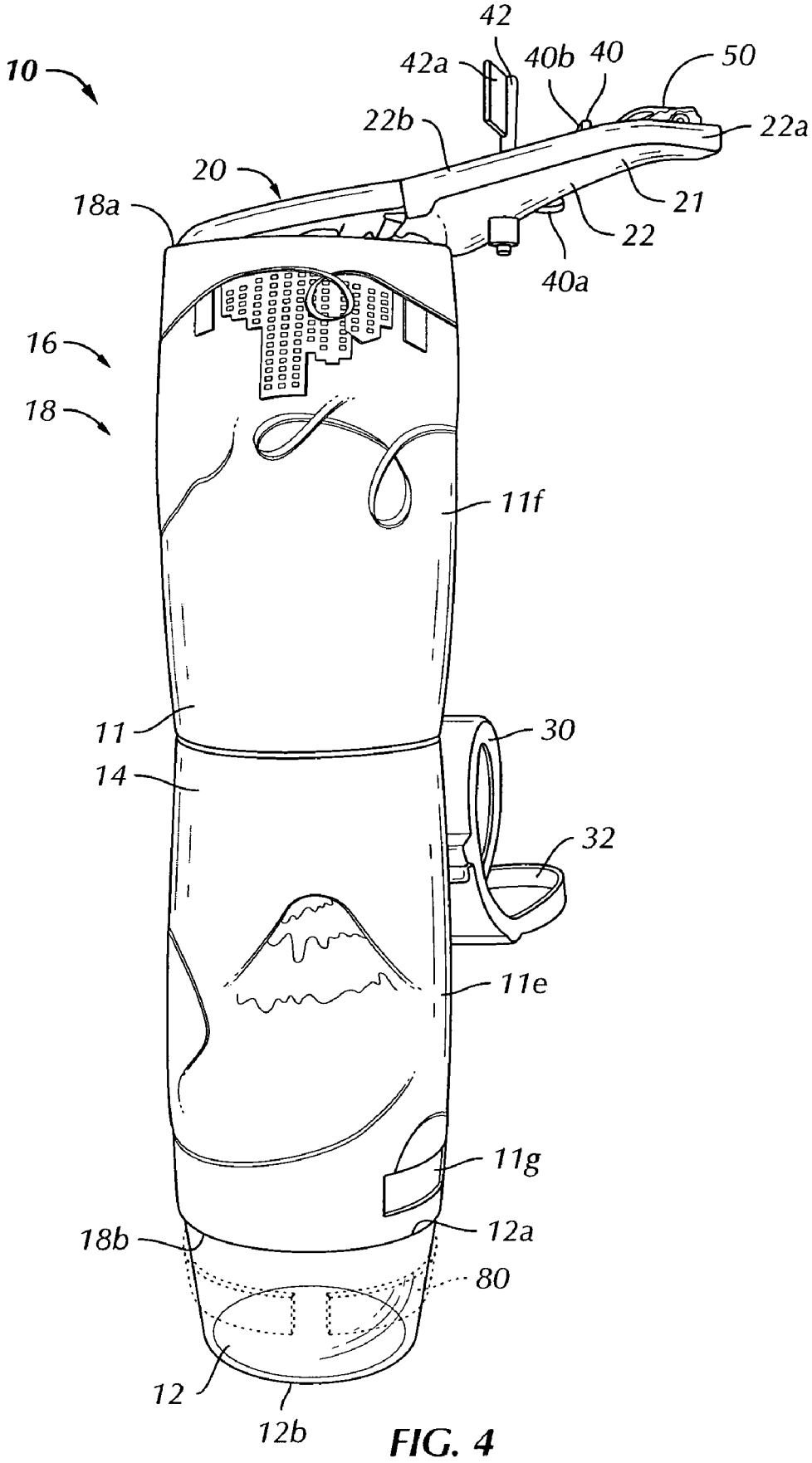
FIG. 4 is a rear perspective view of the toy play set of FIG. 2.

Preferably, the body 11 further has an open configuration 18, best seen in FIGS. 2-4, in which the hollow cavity 1*d* is at least partially accessible. When in the open configuration 18, the first and second portions 11*e*, 11*f* of the body 11 are engaged in a second arrangement 14 in which the first and second portions 11*e*, 11*f* are preferably stacked end to end. Preferably, top ends of the first and second halves 14*a*, 14*b* are engaged, e.g., by tongue and groove, bayonet connectors, or the like, when in the second arrangement 14, such that the bottom ends of the first and second portions 11*e*, 11*f* form opposing first and second longitudinal ends 18*a*, 18*b* of the body 11 in the open configuration 18. That is, the second portion 11*f* is inverted and the top end of the second portion 11*f* is engaged with the top end of the first portion 11*e* to form a small "tower-like" structure. Although it is preferred that the first and second portions 11*e*, 11*f* be stacked in this manner when in the second arrangement 14, it is within the spirit and scope of the present invention that the first and second portions 11*e*, 11*f* be stacked differently or otherwise configured, provided the cavity 11*d* is at least partially accessible.

It is preferred that the lid 12 be removably engageable with at least one of the first and second portions 11*e*, 11*f* with the body 11 in the open configuration 18. Preferably, the lid 12 is engaged with a bottom of the first portion 11*e*. When engaged with one of the first and second portions 11*e*, 11*f*, the lid 12 can be at least partially disposed within the cup holder 80 to support the toy play set 10 in a second generally upright orientation 16 with the other of the first and second portions 11*e*, 11*f* forming a top end of the toy play set 10. In this way, the toy play set 10 in the open configuration 18 can be at least inhibited from tipping over, rolling, or otherwise moving within the vehicle.

Referring to FIGS. 2 and 3, the toy play set 10 further includes a track 20 preferably comprising at least a first track segment 21 and a second track segment 21 that can be engaged with the first track segment 21 to form at least a portion of a generally continuous track 20, which is engaged with the body 11 in the open configuration 18 for use. Preferably, each track segment 21 is sized and configured for storage within the cavity 11*d* of the body 11 in the closed configuration 17. Each of the track segments 21 of the track 20 includes a travel surface 21*a* along which the miniature vehicles 50 can roll and, preferably, each includes side walls 21*b* on either lateral side of the travel surface 21*a*. Each lateral side wall 21*b* extends generally transversely outwardly in the same general direction from the travel surface 21*a*, such that the travel surface 21*a* and the lateral side walls 21*b* form a channel 21*c* within which the at least one miniature vehicle 50 is retained at least along a portion of the track 20. In this way, the channel 21*c* and, specifically, the side walls 21*b* of the track segments 21 inhibit the miniature vehicles 50 from running off of the track segments 21 of the track 20 while the miniature vehicles 50 travel along at least the portion of the track 20 with the side walls 21*b*.

The track 20, when assembled, is preferably configured as follows. The corkscrew section 24 and the drop section 26 are permanently connected to an inside surface of a second portion 11*f* of the body 11, or at least intended to remain engaged therewith while the toy play set 10 is in both the closed and the open configurations 17, 18. The start section 22 engages with uphill edges of the corkscrew section 24 and the drop section 26. Connected to a downhill edge of the corkscrew section 24 is the straight section 28. The loop section 30, the curve section 32, and the finish section 34 are connected in series between a downhill edge of the straight section 28 and the bottom of the first portion 11*e* of the body 11. In particular, as shown in FIGS. 2 and 3, at some location spaced downward from the first terminus 20*a*, the track 20 divides into two track surfaces 20*c*, 20*c*' formed by two track sections 24, 26, each of which continues downward.

The track 20 preferably includes at least one and preferably a plurality of a start section 22, a corkscrew turn section 24, a drop or jump section 26, a straight section 28, a loop section 30, a curve section 32, and a finish section 34. The various sections of the track 20 are releasably engaged with one another with suitable connection methods, such as tongue and groove, bayonet connectors, etc., to ensure smooth transitions from one section of the track 20 to another. It is important that the transitions between sections of track 20 are relatively smooth in order to minimize interference with the rolling motion of the miniature vehicles 50 while traveling along the track 20.

The track 20, when assembled, is preferably configured as follows. The corkscrew section 24 and the drop section 26 are permanently connected to an inside surface of a second portion 11*f* of the body 11, or at least intended to remain engaged therewith while the toy play set 10 is in both the closed and the open configurations 17, 18. The start section 22 engages with uphill edges of the corkscrew section 24 and the drop section 26. Connected to a downhill edge of the corkscrew section 24 is the straight section 28. The loop section 30, the curve section 32, and the finish section 34 are connected in series between a downhill edge of the straight section 28 and the bottom of the first portion 11*e* of the body 11.

Referring now to FIGS. 2-4, preferably, the body 11 has at least one opening sized and shaped so that the at least one miniature vehicle 50 can pass therethrough. Specifically, it is preferred that there be two openings in the first portion 11*e* of the body, including a side exit 11*g* and a bottom exit 11*i*. Preferably, the side exit 11*g* is disposed in the side wall 11*c* of the first portion 11*e* of the body 11, proximate the second terminus 20*b* of the track 20, with the body 11 in the open configuration 18. The bottom exit 11*i* is preferably disposed in the second longitudinal end 18*b* of the body 11 in the open configuration 18, proximate the second terminus 20*b* of the track 20. It is further preferred that, with the open end 12*a* of the lid 12 engaged with the second longitudinal end 18*b* of the body 11 in the open configuration 18, the interior 12*c* of the lid 12 is accessible through the bottom exit 11*i*. Although it is preferred that the toy play set 10 include the above-described two openings 11*g*, 11*i*, it is within the spirit and scope of the present invention that the toy play set 10 include more or less than two openings.

Referring still to FIGS. 2 and 3, the start section 22 has a top portion 22*a* in which the miniature vehicle 50 is placed prior to traveling down the track 20. A barrier 40*b* of a starting gate 40 abuts the miniature vehicle 50, thereby retaining the miniature vehicle 50 in the top portion 22*a* of the start section 22. In order to release the miniature vehicle 50, a tab 40*a* of the starting gate 40 is pressed downwardly to pivot the starting gate 40 with respect to the start section 22, thereby raising the barrier 40*b* out of abutment with the miniature vehicle 50 and allowing the miniature 50 to begin rolling along the track 20.

Preferably, first and second diverters 42, 44 are located at two locations along the track 20 for selecting the path along which the miniature 50 is to travel. Each of the first and second diverters 42, 44 is rotatable with respect to the track 20 by pressing against tabs 42*a*, 44*a*, thereby moving diverter walls 42*b*, 44*b* along the flat surface of the track 20. Doing so effectively blocks at least one of the potential paths along which the miniature vehicles 50 could travel and diverts the path of the miniature vehicle 50 along the one desired path of the track 20.

Specifically, the first diverter 42 can be rotated to select either the corkscrew section 24 or the drop section 26 for the miniature vehicle 50 to travel along, thereby directing the miniature vehicle 50 along one of the two track surfaces 20*c*, 20*c*'. By choosing the corkscrew section 24 (track surface 20*c*), the miniature vehicle 50 rolls along the corkscrew section 24 in a spiral path to the straight section 28. By selecting the drop section 26 (track surface 20*c*'), the miniature vehicle 50 rolls down the drop section 24, drops off a downhill edge of the drop section 26, and lands on the straight section 28.

Preferably, the second diverter 44 can be rotated to select one of three paths. The three paths include the side exit 11*g*, a height meter ramp 11*h*, and the bottom exit 11*i*. The side exit 11*g* allows the miniature vehicle 50 to roll out of an opening in the side wall 11*c* of the first portion 11*e* of the body 11. The height meter ramp 11*h* is preferably a ramp which leads up the interior of the side wall 11*c* of the first portion 11*e*. Upon reaching the bottom of the track 20, the miniature vehicle 50 has a certain amount of speed, which allows the miniature vehicle 50 to roll up the height meter ramp 11*h* a certain amount. Preferably, the height meter ramp 11*h* has numerical markings along it so that the height that the miniature vehicle 50 reaches can be measured. A sliding bar (not shown) can be slideably engaged across the height meter ramp 11*h* so that the miniature vehicle 50 pushes the sliding bar upwardly as it rolls along the height meter ramp 11*h*. It is intended that the sliding bar would slide to the maximum height of the miniature vehicle 50 along the height meter ramp 11*h* and remain there in order to more accurately discern the maximum height reached by the miniature vehicle 50. As described above, the bottom exit 11*i* is essentially an opening in the bottom of the first portion 11*e* which allows the miniature vehicle 50 to drop therethrough and into the interior 11*c* of the lid 12 when engaged to the bottom of first portion 11*e*.

Figure 5:
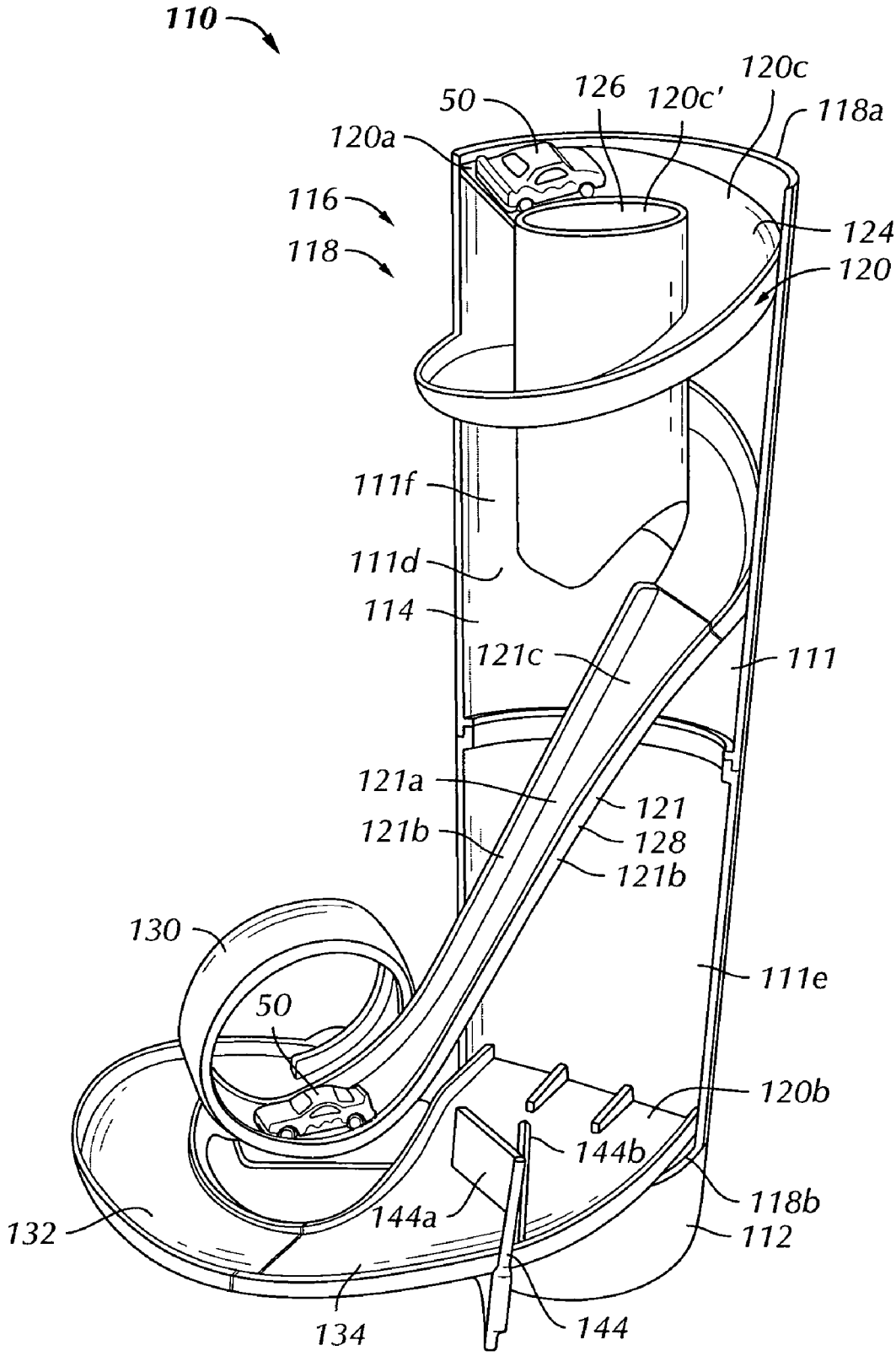
FIG. 5 is a front perspective view of a toy play set, shown in a play configuration, in accordance with a second preferred embodiment of the present invention.

Referring to FIG. 5, the toy play set 110 of the second preferred embodiment is shown. The toy play set 110 is essentially similar to the toy play set 10 of the first preferred embodiment, differing primarily in that a track 120 of the toy play set 110 has no start section or first diverter. Instead, the miniature vehicle 50 is either placed on a corkscrew section 124 (a track surface 120*c*) or within a drop section (a vertical hollow tube) 126 (a track surface 120*c*') in order to start the miniature vehicle 50 along the track 120. Also, at the end of the track 120, although there are still three paths to choose from, all three paths lead into a lid 112 engaged with a bottom of a first portion 111*e* of a body 111, rather than the side exit 11*g*, the height meter ramp 11*h*, and the bottom exit 11*i* of the first preferred embodiment. Although not portrayed, it is within the spirit and scope of the present invention that the side exit, the height meter ramp, and the bottom exit also be used with the toy play set 110 of the second preferred embodiment.

Figure 6:
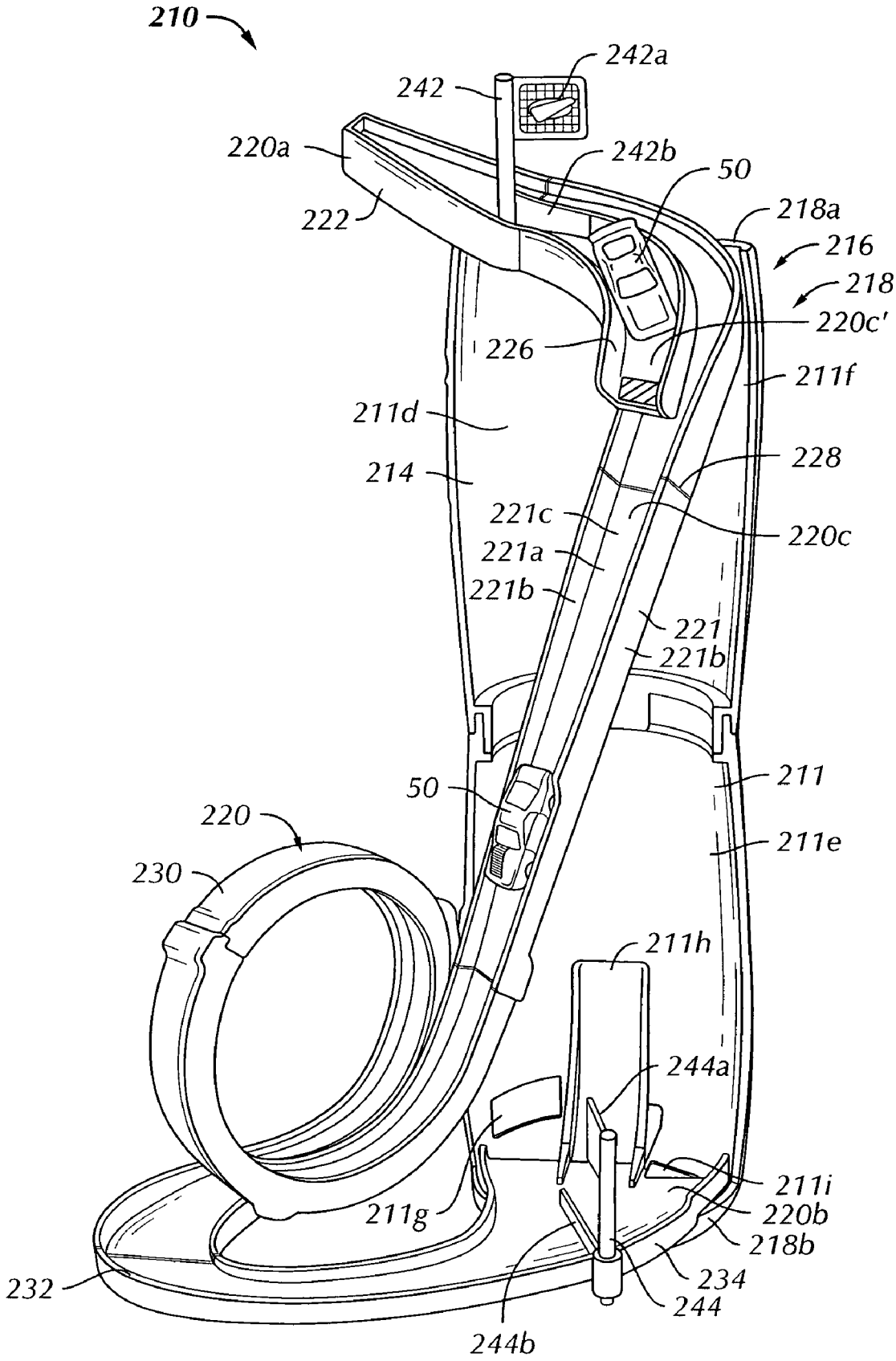
FIG. 6 is a front perspective view of a toy play set, shown in a play configuration, in accordance with a third preferred embodiment of the present invention.

Referring to FIG. 6, the toy play set 210 of the third preferred embodiment is shown. The toy play set 210 is essentially similar to the toy play set 10 of the first preferred embodiment, differing primarily in that a track 220 of the toy play set 210 has no corkscrew section as part of a first track surface 220*c*. Instead, a second curve section 224 replaces the corkscrew section, which, rather than turning through a spiral-like path, merely turns approximately 90 degrees and leads into a straight section 228. Also, the toy play set 210 differs from the toy play set 10 in that it does not have a starting gate. Instead, the miniature vehicle 50 is merely placed within a start section 222 and held by a finger until it is desired to release the miniature vehicle 50 along the track 220.

The structural elements of the toy play set 10, 110, 210 are preferably fabricated from conventional polymeric materials, such as polypropylene. Preferably, the polypropylene of at least the lid 12, 112, 212 is at least semi-translucent so as to allow one to see through the lid 12, 112, 212 in order to see the contents therein. Although portrayed as being made from an opaque polymer, it is contemplated that the body 11, 111, 211 also be made of an at least semi-translucent polymer in order for the contents thereof to be seen through the body 11, 111, 211. Although this is preferred, it is within the spirit and scope of the present invention that the structural elements of the toy play set 10, 110, 210 be made of a different material, so long as the toy play set 10, 110, 210 is capable of performing in the manner described herein.

When in the closed configuration 17, the toy play set 10 stores all of components, namely, the track 20 and the miniature vehicles 50, of the toy play set 10 within the body 11 and lid 12 engaged therewith. When a user desires to play with the toy play set 10, the user opens the toy play set 10 by removing the lid 12 from the body 11 and separating the first portion 11*e* of the body 11 from the second portion 11*f*. All of the components held within the toy play set 10 are separated therefrom once the toy play set 10 is opened. The lid 12 is inverted and attached to the bottom of the first portion 11*e* of the body 11. The second portion 11*f* is also inverted and is attached to the top of the first portion 11*e*, in effect, attaching the tops of each of the first and second portions 11*e*, 11*f* together. The start section 22 is then engaged with the corkscrew section 24 and the drop section 26, which are preferably permanently engaged with the inside of the second portion 11*f*. The straight section 28, the loop section 30, the curve section 32, and the finish section 34 are then attached in sequence to the downhill edge of the corkscrew section 24. The unattached, downhill edge of the finish section 34 is engaged with the downhill edge of the first portion 11*e* of the body 11, thereby assembling the toy play set 10 in the open configuration 18.

Because of the shape of the toy play set 10 when in the closed configuration 17, the toy play set 10 can be at least partially inserted within the cup holder 80 to prevent it from moving around the vehicle. When the toy play set 10 is in the open configuration 18, the lid 12 extends downwardly from the bottom of the first portion 11*e* of the body 11 and can be inserted within the cup holder 80 in order to prevent the toy play set 10 from moving around the vehicle during play. Alternatively, the toy play set 10, when in the open configuration 18, can be placed on a substantially flat surface (not shown) during play with the lid 12 acting as base.

In use, the user places the miniature vehicles 50 on the top portion 22*a* of the start section 22 of the track 20. The path through which the miniature vehicle 50 is to travel can be set by rotating the first diverter 42 to choose one of the corkscrew section 24 and the drop section 26 and by rotating the second diverter 44 to choose one of the side exit 11*g*, the height meter ramp 11*h*, and the bottom exit 11*i*. The miniature vehicle 50 is released to roll down the track 20 along the pre-selected path by pressing on the tab 40*a* with a finger or thumb to lift the barrier 40*b* of the starting gate 40. The user can continue playing with the toy play set 10, choosing different combinations of paths of travel for the miniature vehicles 50. When the user finishes or otherwise tires of playing with the toy play set 10, the toy play set 10 can be disassembled and placed back into the closed configuration 17. In this way, the toy play set 10 is self-contained, and there is a reduced chance of losing the components thereof within the vehicle.

Although not described separately, the operation of the toy play sets 110, 210 of the second and third preferred embodiments is similar to that described above with respect to the toy play set 10 of the first preferred embodiment.

It will be appreciated by those skilled in the art that changes could be made to the embodiments described above without departing from the broad inventive concept thereof. For example, although the disclosed tracks 20, 120, 220 have been made of separate, joinable track sections, it is within the spirit and scope of the present invention that the track be one continuous length, for example, rolled up for storage within the cavity 11*d* or made of generally rigid section that are hinged end to end permitting the sections to be folded up for storage in the cavity 11*d*. While tracks significantly longer in length than the body 11 are preferred, any track having a length at least generally as long as the body 11 between the ends 11*a*, 11*b* is encompassed by the present invention.

It is understood, therefore, that this invention is not limited to the particular embodiments disclosed, but it is intended to cover modifications within the spirit and scope of the present invention.

We claim:

1. A toy play set for use in a vehicle having a beverage cup holder, the toy play set comprising:

a body having first and second opposing ends and a side wall extending therebetween, the first and second ends and the side wall defining an at least partially hollow cavity within the body, whereby the first and second ends and the side wall generally surround the hollow cavity in a closed configuration of the body, the body having in the closed configuration at least the first end sized and shaped to fit at least partially into the cup holder sufficiently for the cup holder to support the body in a first generally upright orientation with the second end forming a top end of the body, the body having an open configuration in which the hollow cavity is at least partially accessible; and a generally continuous track sized and configured for storage within the cavity of the body in the closed configuration, the track being accessible for play and engaged with the body in the open configuration and having a length at least generally as long as the body between the first and second ends and a track surface with a length more than twice the height of the body between the first and second ends in the closed configuration.

2. A toy play set for use in a vehicle having a beverage cup holder, the toy play set comprising:

a body having first and second opposing ends and a side wall extending therebetween, the first and second ends and the side wall defining an at least partially hollow cavity within the body, whereby the first and second ends and the side wall generally surround the hollow cavity in a closed configuration of the body, the body having in the closed configuration at least the first end sized and shaped to fit at least partially into the cup holder sufficiently for the cup holder to support the body in a first generally upright orientation with the second end forming a top end of the body, the body having an open configuration in which the hollow cavity is at least partially accessible; and a generally continuous track sized and configured for storage within the cavity of the body in the closed configuration, the track being accessible for play and engaged with the body in the open configuration and having a length at least generally as long as the body between the first and second ends, wherein the track divides into two separate track surfaces extending over only a portion of the length of the track.

3. The toy play set of claim 2, further comprising a movable diverter located to direct a toy vehicle along a selected one of the two separate track surfaces.

4. The toy play of claim 2, wherein one of the two separate track surfaces is a corkscrew turn section.

5. A toy play set for use in a vehicle having a beverage cup holder, the toy play set comprising:

a body having first and second opposing ends and a side wall extending therebetween, the first and second ends and the side wall defining an at least partially hollow cavity within the body, whereby the first and second ends and the side wall generally surround the hollow cavity in a closed configuration of the body, the body having in the closed configuration at least the first end sized and shaped to fit at least partially into the cup holder sufficiently for the cup holder to support the body in a first generally upright orientation with the second end forming a top end of the body, the body having an open configuration in which the hollow cavity is at least partially accessible; and a generally continuous track sized and configured for storage within the cavity of the body in the closed configuration, the track being accessible for play and engaged with the body in the open configuration and having a length at least generally as long as the body between the first and second ends and including at least a first track segment and a second track segment releasably engaged with the first track segment to form at least part of the generally continuous track, the track being engaged with the body in the open configuration during use.

6. The toy play set of claim 5, wherein the track has a height greater than a height of the body between the first and second ends in the closed configuration.

7. The toy play set of claim 5, wherein at least a portion of the track extends outside the hollow cavity with the track engaged with the body in the open configuration.

8. The toy play set of claim 5, further comprising a lid removably engageable with at least one of the first and second ends of the body in the closed configuration.

9. The toy play set of claim 5, wherein the body includes at least a first portion and a second portion removably engageable with the first portion.

10. The toy play set of claim 5, wherein the side wall of the body is generally annular.

11. A toy play set for use in a vehicle having a beverage cup holder, the toy play set comprising:

a body having first and second opposing ends and a side wall extending therebetween, the first and second ends and the side wall defining an at least partially hollow cavity within the body, whereby the first and second ends and the side wall generally surround the hollow cavity in a closed configuration of the body, the body having in the closed configuration at least the first end sized and shaped to fit at least partially into the cup holder sufficiently for the cup holder to support the body in a first generally upright orientation with the second end forming a top end of the body, the body having an open configuration in which the hollow cavity is at least partially accessible;

a generally continuous track sized and configured for storage within the cavity of the body in the closed configuration, the track being accessible for play and engaged with the body in the open configuration and having a length at least generally as long as the body between the first and second ends; and a lid removably engageable with at least one of the first and second ends of the body in the closed configuration, wherein the lid has an open end and an oppositely disposed closed end, a sidewall extends generally perpendicularly from an outer circumference of the closed end to form the open end, wherein, in the closed configuration, the open end engages the body.

12. The toy play set of claim 11, wherein, with the lid engaged with one of the first and second ends of the body, the lid is sized and shaped to fit at least partially into the cup holder.

13. The toy play set of claim 12, in combination with at least one toy vehicle sized to be secured in the lid coupled to the body in the closed configuration of the body, wherein the lid is sufficiently transparent to see the toy vehicle therein.

14. A toy play set for use in a vehicle having a beverage cup holder, the toy play set comprising:

a body having first and second opposing ends and a side wall extending therebetween, the first and second ends and the side wall defining an at least partially hollow cavity within the body, whereby the first and second ends and the side wall generally surround the hollow cavity in a cksed configuration of the body, the body having in the closed configuration at least the first end sized and shaped to fit at least partially into the cup holder sufficiently for the cup holder to support the body in a first generally upright orientation with the second end forming a top end of the body, the body having an open configuration in which the hollow cavity is at least partially accessible; and a generally continuous track sized and configured for storage within the cavity of the body in the closed configuration, the track being accessible for play and engaged with the body in the open configuration and having a length at least generally as long as the body between the first and second ends;

wherein the body includes at least a first portion and a second portion removably engageable with the first portion and wherein, with the body in the closed configuration, the first and second portions are engaged in a first arrangement so that each of the first and second portions forms at least part of the side wall of the body.

15. The toy play set of claim 14, wherein, with the body in the open configuration, the first and second portions of the body are engaged in a second arrangement in which the first and second body portions are stacked end to end.

16. The toy play set of claim 15, further comprising a lid removably engageable with at least one of the first and second portions with the body in the open configuration.

17. The toy play set of claim 16, wherein the lid is generally cup-shaped with an open end and an oppositely disposed closed end.

18. The toy play set of claim 17, wherein, with the lid engaged with one of the first and second portions, the lid is sized and shaped to fit at least partially into the cup holder sufficiently for the cup holder to support the toy play set in a second generally upright orientation with the other of the first and second portions forming a top end of the toy play set.

19. The toy play set of claim 15, wherein the track of the toy play set includes at least a first track segment and a second track segment engaged with the first track segment to form the generally continuous track.

20. The toy play set of claim 19, wherein the track includes at least one of a corkscrew turn, a jump, and a loop.

21. The toy play set of claim 19, wherein the track includes at least two of a corkscrew turn, a jump, and a loop.

22. The toy play set of claim 19, wherein the track includes a corkscrew turn, a jump, and a loop.

23. The toy play set of claim 19, wherein the body in the open configuration has first and second longitudinal ends, a first terminus of the track being disposed proximate the first longitudinal end and a second terminus of the track being disposed proximate the second longitudinal end.

24. The toy play set of claim 23, further comprising at least one miniature vehicle sized and shaped to travel along the track during play.

25. The toy play set of claim 24, wherein each track segment of the track includes a travel surface and a side wall on either lateral side of the travel surface, each lateral side wall extending generally transversely from the travel surface, such that the travel surface and the lateral side walls form a channel within which the at least one miniature vehicle is retained at least along a portion of the length of the track.

26. The toy play set of claim 25, wherein the at least one miniature vehicle is urged along the track by gravity.

27. The toy play set of claim 24, wherein the body has at least one opening sized and shaped so that the at least one miniature vehicle can pass therethrough.

28. The toy play set of claim 27, wherein the at least one opening is in the side wall of the body proximate the second terminus of the track.

29. The toy play set of claim 27, wherein the at least one opening is in the second longitudinal end of the body proximate the second terminus of the track.

30. The toy play set of claim 29, further comprising a lid removably engageable with at least the second longitudinal end of the body in the open configuration, the lid being generally cup-shaped with an open end and an oppositely disposed closed end, such that, with the open end of the lid engaged with the second longitudinal end of the body in the open configuration, an interior of the lid is accessible though the at least one opening.

31. The toy play set of claim 15, wherein the track includes a track surface longer than the height of the first and second body portions stacked end to end in the second arrangement.

* * * * *